US007128655B2

(12) United States Patent
Jones

(10) Patent No.: US 7,128,655 B2
(45) Date of Patent: Oct. 31, 2006

(54) PUTTING PRACTICE GOLF CUP

(76) Inventor: William Jones, 104 Bull Run Rd., Brownsville, PA (US) 15417

( * ) Notice: Subject to any disclaimer, the term of this patent is extended or adjusted under 35 U.S.C. 154(b) by 0 days.

(21) Appl. No.: 10/906,554

(22) Filed: Feb. 24, 2005

(65) Prior Publication Data

US 2006/0189400 A1 Aug. 24, 2006

(51) Int. Cl.
*A63B 69/36* (2006.01)

(52) U.S. Cl. ..... 473/180

(58) Field of Classification Search ..... 473/180–189, 473/172

See application file for complete search history.

(56) References Cited

U.S. PATENT DOCUMENTS

| | | | | |
|---|---|---|---|---|
| 1,295,437 | A | 2/1919 | Cogswell | |
| D83,502 | S | 3/1931 | Carter | |
| 1,887,642 | A | 11/1932 | Howland | |
| 1,893,402 | A * | 1/1933 | Ehrlich | 473/185 |
| 2,849,238 | A | 2/1956 | Eldredge | |
| 2,938,729 | A * | 5/1960 | Billfaldt | 473/180 |
| 3,074,722 | A * | 1/1963 | Davenport | 473/189 |
| 3,310,313 | A * | 3/1967 | Colson | 473/185 |
| 3,356,370 | A * | 12/1967 | Larsen | 473/172 |
| 3,451,682 | A * | 6/1969 | Trimble | 473/189 |
| 3,492,003 | A * | 1/1970 | Scholin | 473/182 |
| 3,652,095 | A * | 3/1972 | Furnari et al. | 473/172 |
| 3,868,111 | A | 2/1975 | Schuelke | |
| 3,912,276 | A * | 10/1975 | Keicher | 473/189 |
| 4,877,251 | A * | 10/1989 | Faust | 473/180 |
| 5,310,187 | A | 5/1994 | Yamaguchi | |
| 5,752,703 | A * | 5/1998 | Wong | 273/342 |
| D477,044 | S * | 7/2003 | Davis | D21/790 |
| 6,663,495 | B1 | 12/2003 | Fun | |

FOREIGN PATENT DOCUMENTS

| | | |
|---|---|---|
| GB | 23264 | 10/1911 |
| GB | 358914 | 10/1931 |

* cited by examiner

*Primary Examiner*—Mark S. Graham
(74) *Attorney, Agent, or Firm*—Albert Peter Durigon

(57) ABSTRACT

A novel putting practice golf cup provides greater development of muscle memory the more aimpoint, clubhead squaring and pacing are practiced resulting in higher confidence and better putting performance during actual play. The putting practice golf cup of the presently preferred and exemplary embodiment of the present invention includes a monolithic body having a first target portion shaped as a golf cup and a second foot portion integrally formed with the first target portion to allow manual placement of the monolithic body upon any indoor or outdoor surface so that the first target portion shaped as a golf cup may be used as an aboveground putting practice target cup.

7 Claims, 3 Drawing Sheets

PUTTING PRACTICE GOLF CUP

FIELD OF THE INVENTION

This invention is drawn to the field of games using tangible projectiles, more particularly, to a golf practice device, and still more particularly, to a novel putting practice golf cup.

BACKGROUND OF THE INVENTION

Golf is a game with the object of getting the ball in the cup with the fewest number of strokes per hole. Since strokes accumulate each hole from off-green or green play, it is as important to putt well as it is to get to the green with the minimum number of strokes.

On each green, the golfer putts the ball towards the cup by 1.) swinging the putter along a line intended to aim the ball to the cup along an aimpoint trajectory, 2.) by angling the putter so that it squarely impacts the ball at the ball striking location, and 3.) by striking it with just enough force to cause the ball to roll into the cup. Of course, even when properly aimed, squared and paced, other factors not within the control of the golfer, such as the grain of the green, surface condition and the like, may intervene and prevent the ball from rolling into the cup. Nonetheless, the more control of aimpoint, clubhead squaring and pacing the golfer has, the fewer the number of strokes that will be taken for any given green conditions and the lower will be the golfer's overall competitive score. Since practice makes perfect, there is thus the need to provide a putting practice golf cup that enables to improve control of aimpoint, clubhead squaring and pacing.

SUMMARY OF THE INVENTION

It accordingly is one object of the present invention to provide a putting practice golf cup that enables to practice aimpoint.

It is another object of the present invention to provide a putting practice golf cup that enables to practice clubhead squaring.

It is a further object of the present invention to provide a putting practice golf cup that enables to practice pacing.

It is a related object of the present invention to provide such a putting practice golf cup as enables to practice aimpoint, clubhead squaring and pacing that is enjoyable to use while being comparatively inexpensive to fabricate.

It is another related object of the present invention to provide a novel putting practice golf cup of the type described that provides greater development of muscle memory the more aimpoint, clubhead squaring and pacing are practiced resulting in higher confidence and better putting performance during actual play.

In accord with these and other objects, the putting practice golf cup of the present invention contemplates a monolithic body that includes a first target portion shaped as a golf cup, and a second foot portion integrally formed with the first target portion to allow manual placement of the monolithic body upon any indoor or outdoor surface so that the first target portion shaped as a golf cup may be used as an aboveground putting practice target cup.

According to one inventive aspect, the first target portion of the monolithic body shaped as a golf cup has open proximate and distal ends respectively of comparatively-larger and comparatively-smaller areas that so cooperate that the comparatively-smaller distal end is visible through the comparatively-larger proximate end to define a bull's-eye that enables to practice aimpoint when the first target portion is remotely viewed endwise from an intended distance for practicing putting.

According to another inventive aspect, the first target portion of the monolithic body shaped as a golf cup has a generally frusto-conical wall joining the open proximate and distal ends to define a passageway extending from the proximate to the distal ends of the first target portion that progressively diminishes in cross-section the closer the passageway approaches the distal end that enables to practice clubhead squaring when the first target portion is addressed endwise from an intended distance for practicing putting.

According to a further inventive aspect, the proximate end of the frusto-conical wall of the first target portion of the monolithic body is contained in a plane that is inclined towards the distal end so as to expose to view the distal open end, and the inside of the generally frusto-conical wall, when the first target portion is remotely viewed endwise at an intended distance for practicing putting.

According to another inventive aspect, the proximate end of the frusto-conical wall of the first target portion shaped as a golf cup has a cross-sectional area that corresponds to the cross-sectional area of a standard in-the-ground golf cup, the distal end is just larger in diameter than a standard golf ball and the length of the frusto-conical wall corresponds to the depth of a standard golf cup.

According to yet another inventive aspect, the second foot portion integrally formed with the first target portion is generally rectangularly shaped.

BRIEF DESCRIPTION OF THE DRAWINGS

These and other objects, inventive aspects and advantageous features of the present invention will become apparent as the invention becomes better understood by referring to the following, solely exemplary, detailed description of the presently preferred embodiments, and to the drawings, wherein.

DETAILED DESCRIPTION OF THE PRESENTLY PREFERRED EMBODIMENTS

Figure 1A:
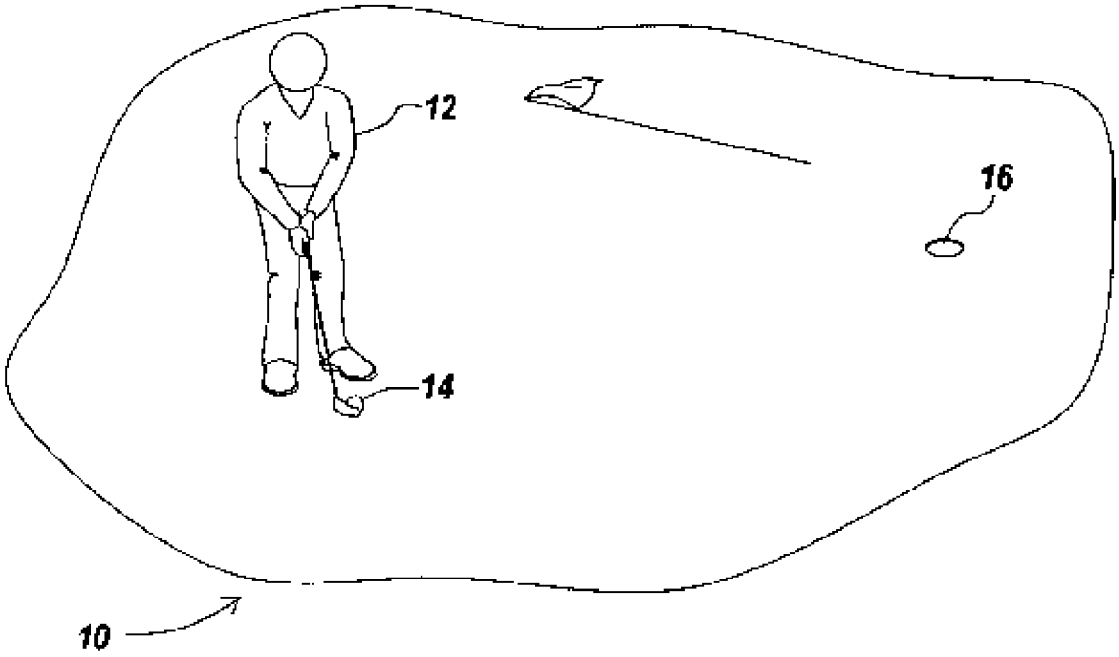
FIG. 1 in the FIGS. 1A and 1B thereof presents pictorial and schematic drawings respectively illustrating a golfer on a putting green and the mechanics of putting.

Referring now to FIG. 1A, generally designated at 10 is a pictorial diagram showing a golfer 12 addressing a ball 14, a cup 16 removed from the golfer 12 and a putter 18 in use to strike the ball 14. Whether or not the ball 14 rolls into the cup 16 on any given stroke depends both on variables such as the grain of the green or the presence of small stones or other factors not within the control of the golfer and on variables to be described within the control of the golfer.

Since the score is lower the fewer the number of strokes needed to sink the ball into the cup each hole, the mastery of the putting variables within the control of the golfer may very well determine the ultimate outcome of a competitive round of golf.

Figure 1B:
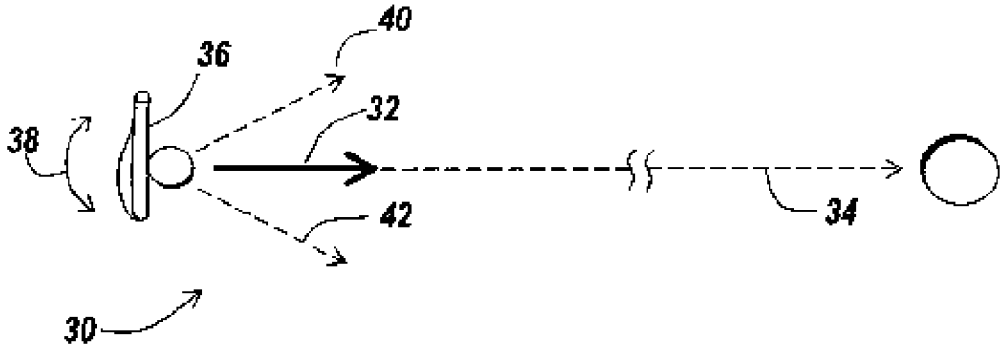

Referring now to FIG. 1B, generally designated at 30 is a schematic diagram useful in explaining the three (3) principal variables within the control of the golfer upon which the golfer's ability to sink any given putt critically depends. After having "read" the green, the golfer swings the putter in a direction along a line schematically illustrated by vector 32 intended to aim the ball to the cup along an aimpoint trajectory 34. The direction of the vector 32 depicts the line along which the putter is directed to aim the ball to the cup along the aimpoint trajectory 34. The trajectory 34, illustrated as a straight path, may and will often be curved, not shown, in dependence on the particular inclination of the green and the actual approach to and location of the cup. The magnitude of the vector 32 depicts pacing, another of the principal putting variables within the critical control of the golfer. As will be readily appreciated, the magnitude of the force imparted by the clubhead to the ball at the ball striking location must be such that it is strong enough to cause the ball to roll all the way to and into the cup but not so strong that it rolls over or is otherwise diverted from out of the cup. The third principal variable is the angle the clubhead 36 makes with the ball when the ball is struck at the ball striking location. When the clubhead 36 strikes the ball perpendicular to the intended line of flight, illustrated by the direction of the vector 32, the ball rolls along the aimpoint trajectory 34 towards the cup. But when the clubhead strikes the ball at an angle that is not square to the intended line of flight due to unintentional rolling or twisting of the hands at the ball striking location as schematically illustrated by arrow 38, off-axis force components are produced that act to cause the ball to roll off the aimpoint trajectory 34 as schematically illustrated by arrows 40, 42.

Figure 2A:
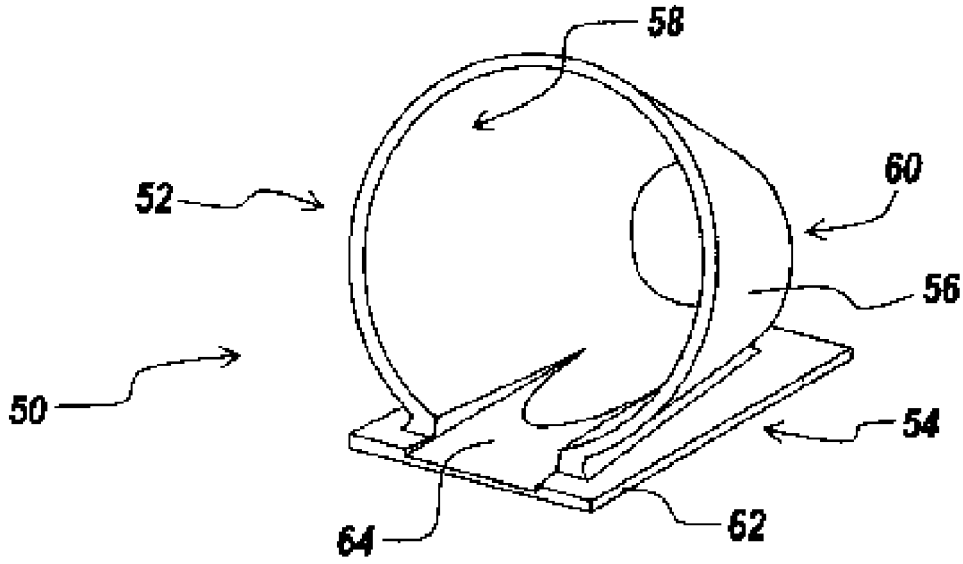
FIG. 2A is a front isometric view of the novel putting practice golf cup of the present invention.

Referring now to FIG. 2, generally designated at 50 in FIG. 2A is a front isometric view of a putting practice golf cup in accord with the present invention that enables a golfer to practice aimpoint, clubhead squaring and pacing in a manner to be described. The putting practice golf cup 50 includes an upper target portion generally designated 52 shaped as a golf cup to be described and a foot portion generally designated 54 under the target portion 52. The foot portion 54 allows placement of the putting practice golf cup 50 upon any indoor or outdoor surface so that the target portion 52 may be used as an aboveground putting practice target cup. Preferably, the putting practice golf cup 50 is fabricated of a thermoplastic material by injection molding as a monolithic body having integrally formed upper target and lower foot portions 52, 54, although it may be otherwise fabricated without departing from the inventive concepts.

Figure 2B:
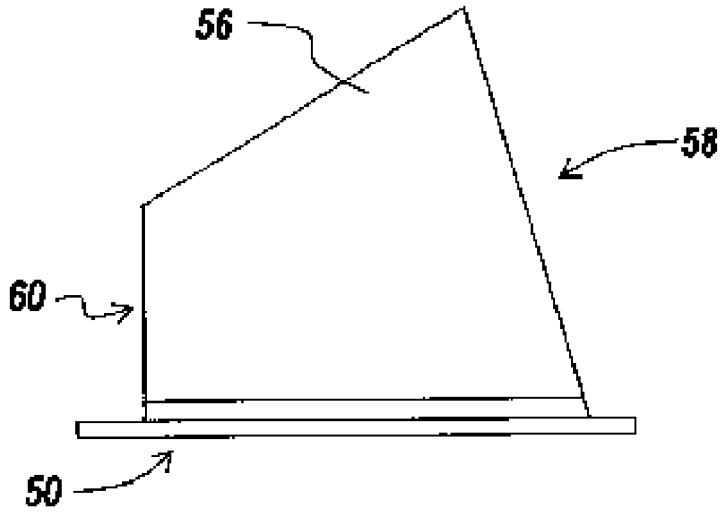
FIG. 2B is a side elevational view of the putting practice golf cup of the present invention.

The target portion 52 shaped as a golf cup of the putting practice golf cup 50 includes a generally frusto-conical wall 56 elongated along a generally horizontal axis that terminates in comparatively-larger and comparatively-smaller proximate and distal open ends generally designated 58, 60. The proximate end 58 preferably has a preselected diameter that is selected to correspond to the mouth size of a standard golf cup, preferably four and one forth (4.25) inches; the distal end 60 has a diameter, preferably one and eight-tenths (1.8) inches, sized to allow passage of a standard US golf ball; and the axial length of the generally frusto-conical wall 56 corresponds to the range of depths of a US golf hole, preferably four and thirty five hundredths (4.35) inches, and generally within a range of about three to five (3–5) inches. Other dimensions corresponding to different standard ball and cup sizes or novelty sizes may be employed. As best seen in FIG. 2B, the proximate end 58 of the generally frusto-conical wall 56 of the target portion 52 preferably is contained in a plane that is inclined downwardly toward the distal end 60. The distal end 60 preferably is contained by a vertical plane. The angle made by the plane containing the proximate end 58 is selected to open the inside and distal end 60 of the generally frusto-conical wall 56 to view endwise when viewed remotely from an intended putting practice distance, one hundred six and one-forth (106.25) degrees in the presently preferred embodiment.

The foot portion 54 of the putting practice golf cup 50 includes a generally rectangular base 62 that allows the putting practice golf cup 50 to be placed upon any indoor or outdoor surface so that the target portion 52 shaped as a golf cup may be used as an aboveground putting practice cup. The generally rectangular base 62 of the foot portion 54 includes a beveled entry ramp 64 wider than the diameter of a standard play US golf ball, preferably one and eight-tenths (1.8) inches wide. The bottom surface, not shown, of the base 62 of the foot portion 54 preferably is smooth, although downwardly directed members such as spikes may be provided to anchor the cup 50 to its supporting ground.

In use, the putting practice golf cup 50 enables to practice aimpoint, clubhead squaring and pacing. The more aimpoint, clubhead squaring and pacing are practiced, the greater muscle memory is developed resulting in higher confidence and better putting performance during game play.

Figure 2C:
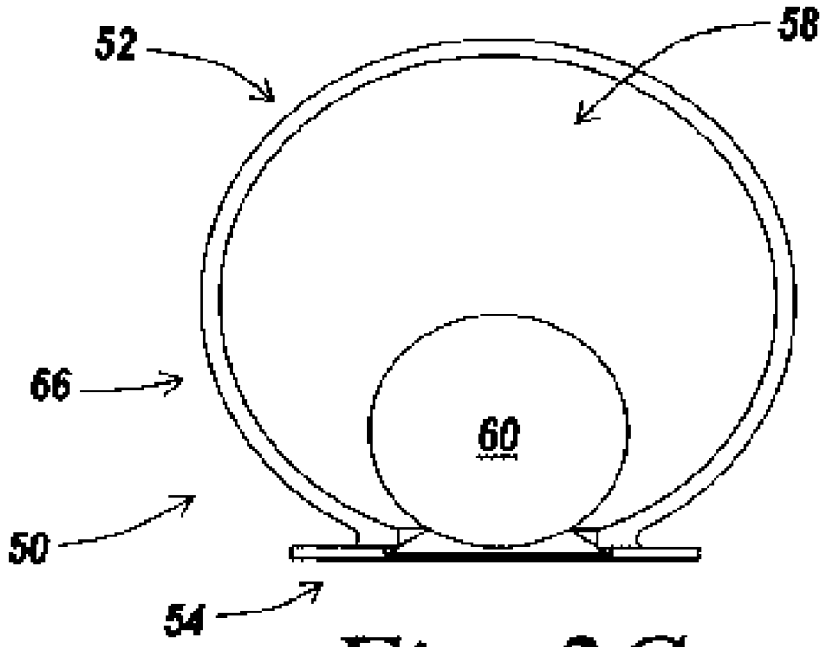
FIG. 2C is a front end view of the putting practice golf cup illustrating the bull's-eye that enables to practice aimpoint.
Figure 2D:
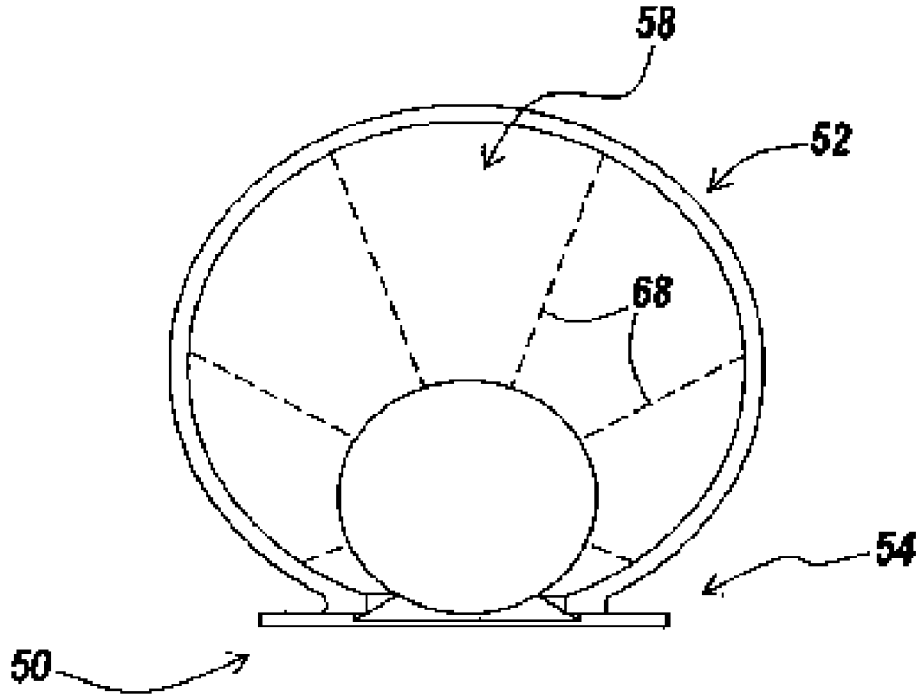
FIG. 2D is a front end view of the putting practice golf cup schematically illustrating in dashed lines the passageway of progressively reduced cross-section of the generally frusto-conical wall that enables to practice clubhead squaring.

Aimpoint practice is enabled by the bull's-eye 66 best seen in FIG. 2C that is provided by the comparatively-larger and comparatively-smaller open ends 58, 60 when the putting practice golf cup 50 is remotely viewed endwise act an intended distance for putting practice. Clubhead squaring practice is enabled by the generally frusto-conical wall 56 of the target portion 52 of the putting practice golf cup 50. As schematically illustrated by dashed lines 66 in FIG. 2D, the axial passageway through the generally frusto-conical wall 56 progressively diminishes in cross-section with depth of entry into the target portion 52. The more off-axis the roll, the shorter the distance the ball travels along the passageway before striking the frusto-conical wall 56; conversely, the less the roll is off-axis, the longer the distance the ball travels along the passageway before striking the frusto-conical wall 56. In this manner, the putting practice golf cup 50 provides the golfer with audible and visible feedback enabling fine adjustment of clubhead squaring at the ball striking location. Pacing practice is enabled by observing and adjusting for how far the ball rolls short or long of the putting practice target cup 50.

Many modifications of the presently disclosed invention will become apparent to those of ordinary skill in the art having benefitted from the instant disclosure without departing from the inventive concepts.

What is claimed is:

1. A putting practice golf cup that enables to practice aimpoint, clubhead squaring and pacing, comprising:

a monolithic portable body that includes an upper first target portion shaped as a golf cup having open proximate and distal ends and defining a stationary passageway linearly extending through the golf cup shaped first portion from the open proximate end to the open distal end along a straight, generally horizontal axis, and a second foot portion integrally formed under and upwardly supporting the first target portion that allows manual placement of the second foot portion on any indoor or outdoor supporting surface so that the stationery passageway running through the golf cup shaped first target portion may be used as an aboveground putting practice target cup when remotely viewed at an intended distance for putting practice;

wherein said open proximate and distal ends of said first target portion shaped as a golf cup of said monolithic portable body are respectively of comparatively-larger and comparatively-smaller areas that cooperate to define a bull's-eye when the first target portion of the monolithic portable body is remotely viewed endwise at an intended distance for putting practice, enabling to practice aimpoint when the bull's-eve of the first target portion of the monolithic portable body is remotely viewed and the ball is addressed at the ball striking location by aiming the ball along an intended trajectory towards the bull's-eve of the first target portion of the monolithic portable body;

wherein said first target portion shaped as a golf cup of the monolithic portable body has a generally frusto-conical wall joining the open proximate and distal ends along said linearly extending stationery passageway that progressively diminishes in cross-section with depth of entry into the linearly extending stationery passageway of the target portion of the monolithic portable body such that the more squarely the ball is struck at the ball striking location the longer the distance the ball travels along the linearly extending stationery passageway, and the less squarely the ball is struck at the ball striking location the shorter the distance the ball travels along the linearly extending stationery passageway before striking the frusto-conical wall when the first target portion of the monolithic portable body is remotely viewed at an intended distance for putting practice and the ball is addressed at the ball striking location by squaring the clubhead along said aimpoint trajectory; and wherein said pacing practice is enabled by how short of the proximate end and how long of the distal end a practice ball is when the first target portion is remotely viewed at an intended distance for putting practice and the ball addressed by striking it with not enough or too much force at the ball striking location.

2. The putting practice golf cup of claim 1, wherein the proximate end of the frusto-conical wall of the first target portion of the portable, monolithic body is contained in a plane that is inclined towards the distal end so as to open to view the distal end, and the inside of the generally frusto-conical wall, when the first target portion is remotely viewed endwise at an intended distance for practicing putting.

3. The putting practice golf cup of claim 1, wherein the proximate end of the generally frusto-conical wall of the first target portion has a cross-sectional area that corresponds to the cross-sectional area of the mouth of a standard in the ground golf cup.

4. The putting practice golf cup of claim 1, wherein the distal end of the generally frusto-conical wall of the first target portion has a cross-sectional area just larger in cross-sectional area than the cross-sectional area of a standard golf ball.

5. The putting practice golf cup of claim 1, wherein the axial length of the generally frusto-conical wall of the first target portion generally corresponds to the depth of a golf cup, about three to five inches.

6. The putting practice golf cup of claim 1, wherein the second foot portion integrally formed with the first target portion is generally rectangularly shaped.

7. The putting practice golf cup of claim 6, wherein the generally rectangularly shaped second foot portion integrally formed with the first target portion has a smooth bottom surface.

* * * * *